US006282844B1

(12) United States Patent
Marable

(10) Patent No.: US 6,282,844 B1
(45) Date of Patent: Sep. 4, 2001

(54) GARGOYLE STYLE DIVERTER FOR RAIN GUTTERS

(76) Inventor: Simeon David Marable, 18 Spindle Tree Rd., Levittown, PA (US) 19056

( * ) Notice: Subject to any disclaimer, the term of this patent is extended or adjusted under 35 U.S.C. 154(b) by 0 days.

(21) Appl. No.: 09/468,757

(22) Filed: Dec. 21, 1999

(51) Int. Cl.[7] ..... E02D 9/04; E04B 13/06
(52) U.S. Cl. ..... 52/11; 52/16
(58) Field of Search ..... 52/11, 16

(56) References Cited

U.S. PATENT DOCUMENTS

| | | | | |
|---|---|---|---|---|
| 2,210,248 | | 8/1940 | Lighthill . | |
| 3,889,474 | * | 6/1975 | Frangmeier | 52/16 X |
| 4,028,895 | * | 6/1977 | Franzmeier | 52/16 X |
| 5,014,745 | * | 5/1991 | Watt | 52/16 X |
| 5,522,427 | * | 6/1996 | Johnson | 52/16 X |
| 5,526,612 | | 6/1996 | Wade . | |
| 5,535,554 | | 7/1996 | Harris, Jr. . | |
| 5,718,572 | * | 2/1998 | Hitzel | 431/292 |
| 5,772,882 | | 6/1998 | Chang . | |
| 5,802,775 | | 9/1998 | Toth . | |

* cited by examiner

*Primary Examiner*—Christopher T. Kent
(74) *Attorney, Agent, or Firm*—Henderson & Sturm LLP

(57) ABSTRACT

A gargoyle style diverter construction (10) for rain gutters (100) wherein the diverter construction (10) includes a mounting unit (11) having a U-shaped mounting member (20) including a mounting plate element (24) and a pair of elongated legs (21), (22) which are formed integrally with a gargoyle style spout unit (12) which includes a bottom panel (31) and a pair of raised side walls (32), (33), which are disposed in a surrounding relationship to a group of fluid outlet openings (105) formed in the exterior side wall (104) of the rain gutter (100).

15 Claims, 2 Drawing Sheets

GARGOYLE STYLE DIVERTER FOR RAIN GUTTERS

BACKGROUND OF THE INVENTION

1. Field of the Invention

The present invention relates to the field of rain gutter constructions in general, and in particular to a rain gutter provided with a water diverter in the shape of a gargoyle.

2. Description of Related Art

As can be seen by reference to the following U.S. Pat. Nos. 2,210,248; 5,526,612; 5,535,554; 5,772,882; and 5,802,775, the prior art is replete with myriad and diverse rain gutter constructions.

While all of the aforementioned prior art constructions are more than adequate for the basic purpose and function for which they have been specifically designed, they are uniformly deficient with respect to their failure to provide a simple, efficient, and practical way to divert a portion of the collected rain water to a location spaced from the down spout, so that some of the water can be fed to a collection receptacle.

As anyone who has experienced drought conditions is all too well aware, virtually all of the rain that falls on a conventional peaked roofline provided with an equally conventional gutter system directs all of the collected water into one or more down spouts that discharge the water at ground level at the corners of the house wherein the collected water is virtually wasted.

In addition, many homes are now provided with decorative plantings and flower beds adjacent to the periphery of the home which would certainly benefit if they were to receive even a small portion of the water that is currently being wasted with the present gutter and down spout arrangement.

As a consequence of the foregoing situation, there has existed a longstanding need for a new and improved diverter arrangement for rain gutters that will not only direct a portion of the collected water in a rain gutter to a location that would benefit from additional moisture, but would accomplish this objection in a whimsical and aesthetic fashion, and the provision of such an arrangement is a stated objective of the present invention.

BRIEF SUMMARY OF THE INVENTION

Briefly stated, the gargoyle style diverter for rain gutters that forms the basis of the present invention comprises in general, a gutter mounting unit and a diverter spout unit. The gutter mounting unit is designed to be secured to the bottom of the gutter channel and the diverter spout unit is dimensioned to surround a plurality of apertures formed in the exterior side wall of the rain gutter channel.

As will be explained in greater detail further on in the specification, the attachment unit and the spout unit are fabricated from a single sheet of sheet metal which is cut into a desired pattern and then folded along proscribed lines to create the mounting unit and the spout unit.

In addition, certain modifications to the existing gutter channel will be required to both accommodate the mounting unit and the spout unit, as well as to establish fluid communication between the interior of the gutter channel and the mouth of the spout unit.

Furthermore, both the mounting unit and the spout unit are contoured to produce a gargoyle style appearance when installed on the rain gutter and the mounting unit is further adapted to accommodate an auxiliary decorative panel to enhance the overall aesthetic appearance of the gargoyle style diverter construction.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
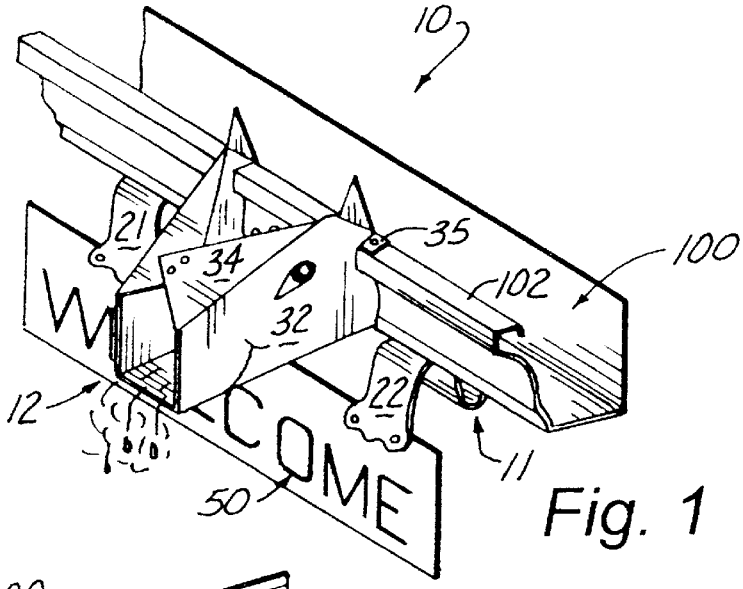
FIG. 1 is a perspective view of the diverter construction installed on a rain gutter.

As can be seen by reference to the drawings, and in particular to FIG. 1, the gargoyle style diverter construction that forms the basis of the present invention is designated generally by the reference number 10. The construction 10 comprises in general a gutter mounting unit 11, and a diverter spout unit 12. These units will now be described in seriatim fashion.

As can be seen by reference to FIGS. 1 through 4, the gutter mounting unit 11 comprises a generally U-shaped mounting member 20. The legs 21, 22 of the U-shaped configuration form decorative leg elements in the finished configuration and the connecting cross piece 23 forms a generally rectangular mounting plate 24 that is dimensioned to conform to the bottom 101 of the rain gutter 100.

Figure 2:
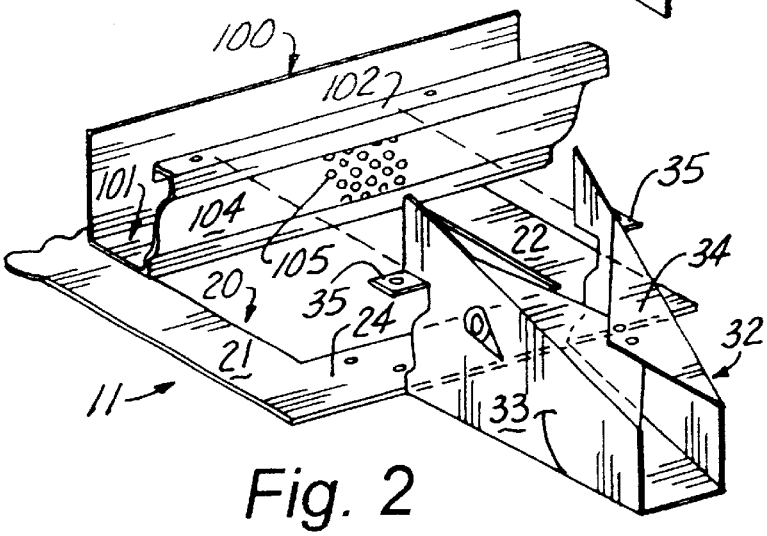
FIG. 2 is an exploded perspective view showing the partially formed diverter construction and the rain gutter.
Figure 4:
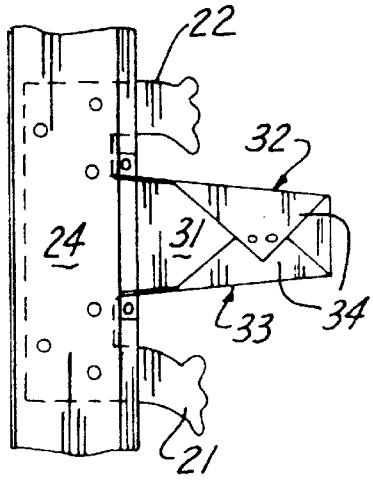
FIG. 4 is a top plan view looking down on the rain gutter and diverter construction.
Figure 5:
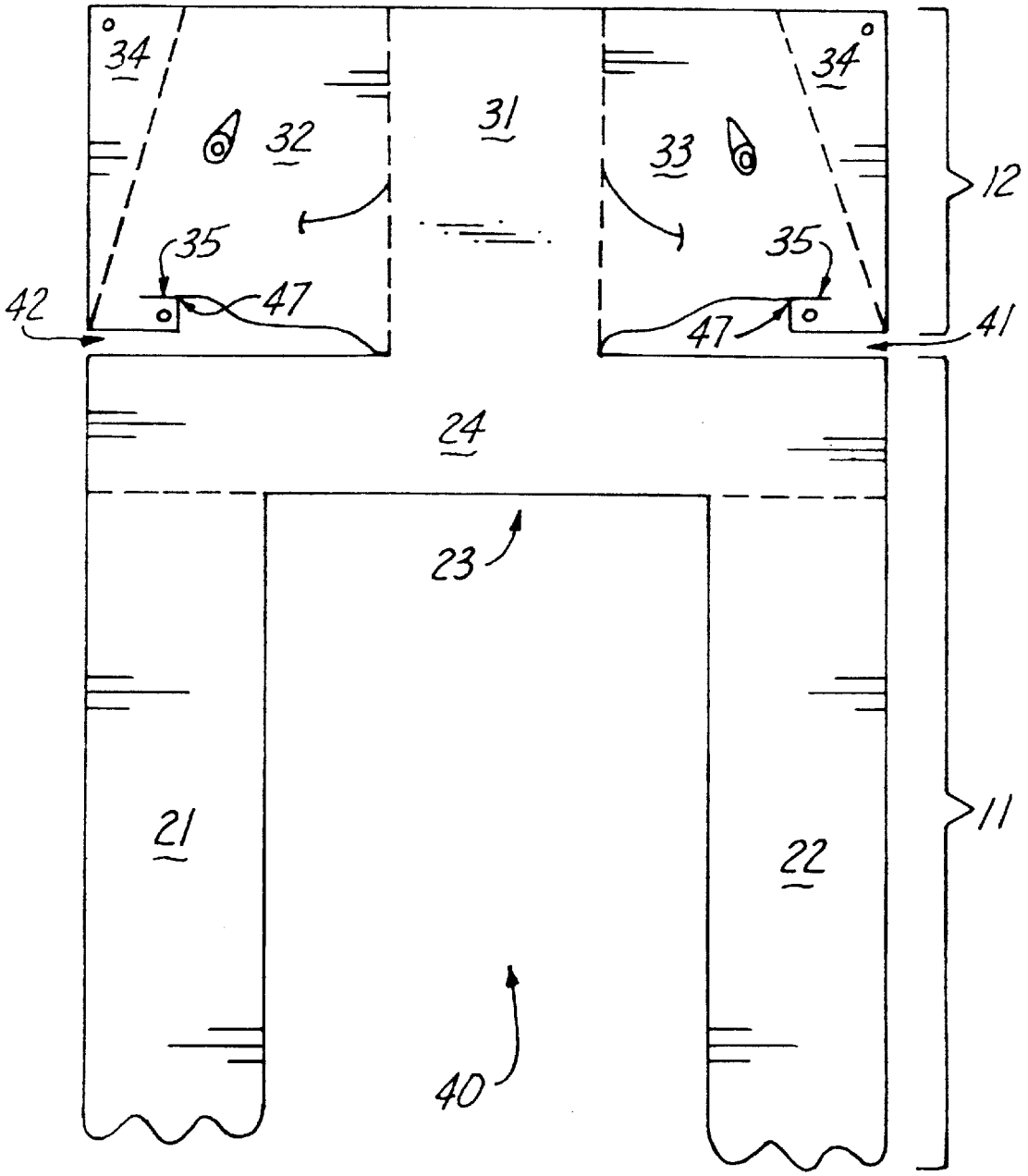
FIG. 5 is a top plan view of the pattern that is employed to fabricate the diverter construction.

As can best be seen by reference to FIGS. 2, 4, and 5, the diverter spout unit 12 is formed integrally with the gutter mounting unit 11 and comprises a spout member 30 having a generally rectangular bottom panel 31 which projects outwardly from the mounting plate 24 and a pair of contoured side walls 32, 33 which project upwardly from the bottom panel 31.

In addition, each of the side walls 32, 33 are provided with inwardly directed flap elements 34 which are secured to one another in an overlapping fashion as depicted in FIGS. 1, 2, and 4, and outwardly projecting mounting tabs 35 which are adapted to be secured to the outer lip 102 of the rain gutter 100 to secure the spout unit 12 thereto.

Turning now to FIG. 5, it can be seen that the diverter construction can be fabricated from a flat sheet of sheet metal or the like. An enlarged generally rectangular opening 40 is created in the bottom portion of the sheet to define the broad outlines of the gutter mounting unit 11.

In addition, two elongated contoured slots 41, 42 extend inwardly from the sides of the rectangular shaped sheet metal. The slots 41, 42 form a substantial structural separation between the gutter mounting unit 11 and the spout unit 12.

As can also be seen by reference to FIG. 5, the contoured slots 41, 42 are notched as at 47 to form the mounting tabs 35 that suspend the spout unit 12 from the exterior lip 102 of the rain gutter and the fold lines are depicted by dashed lines.

Figure 3:
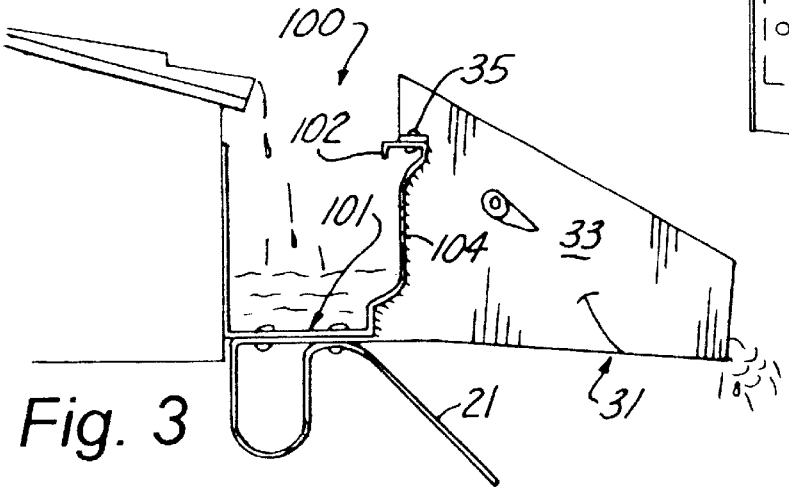
FIG. 3 is a cut away view through the rain gutter showing the disposition of the diverter construction.

Turning now to FIGS. 2 through 4, it can be seen that both the rain gutter 100 and the diverter construction are provided with a plurality of mounting apertures that are dimensioned to accommodate conventional fasteners for attaching the mounting plate 24 to the bottom 101 of the rain gutter 100 and the mounting tabs 35 to the outer lip 102 of the rain gutter.

In addition, the front face 104 of the rain gutter 100 is provided with a group of discrete fluid flow openings 105 that permit a portion of the rainwater collected within the rain gutter to escape out the side of the rain gutter and flow into the spout unit 12 of the diverter construction.

As can also be seen by reference to FIG. 1, this invention also contemplates an auxiliary decorative panel 50 that is affixed to the free ends of the legs 21, 22 of the mounting member 20 to further enhance the aesthetic appearance of the diverter construction.

In addition, the spout unit 12 has a generally tapered configuration that is provided with markings representative of the mouth and eyes of a mythical creature wherein the inboard ends of the raised side walls 32, 33 represent the pointed ears of the creature.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A diverter construction for a rain gutter having a group of fluid outlet openings formed in the exterior side wall of the rain gutter wherein the diverter construction comprises:

a mounting unit including a mounting member including a mounting plate element which is provided with a pair of elongated legs and adapted to be secured to the bottom of the rain gutter; and a spout unit formed integrally with the mounting unit and including a spout member having a bottom wall and two raised side walls whose inboard ends are adapted for being disposed in a surrounding relationship relative to the group of fluid outlet openings formed in the side wall of the rain gutter.

2. The diverter construction as in claim 1 further comprising:

a decorative panel element adapted to be secured to said pair of elongated legs.

3. The diverter construction as in claim 1 wherein each of the raised side walls of the spout unit are provided with a mounting tab element adapted to be secured to a portion of the rain gutter.

4. The diverter construction as in claim 3 wherein the each of the raised side walls are provided with an inwardly directed flap element.

5. The diverter construction as in claim 4 wherein the flap elements are connected to one another.

6. The diverter construction as in claim 5 wherein the spout unit has a generally tapered configuration.

7. The diverter construction as in claim 6 wherein the side walls of the spout unit are provided with indicia representative of the mouth and eyes of a mythical creature.

8. The diverter construction as in claim 7 wherein the raised side walls of the spout unit have inboard ends which are configured to represent the pointed ears of a mythical creature.

9. A diverter construction for a rain gutter having a group of fluid outlet openings formed in the exterior side wall of the rain gutter wherein the diverter construction comprises:

a mounting unit including a mounting member including a mounting plate element which is adapted to be secured to the bottom of the rain gutter; and spout member having a bottom wall and two raised side walls whose inboard ends are adapted for being disposed in a surrounding relationship relative to the group of fluid outlet openings formed in the side wall of the rain gutter wherein each of the raised side walls of the spout unit are provided with a mounting tab element adapted to be secured to a portion of the rain gutter and an inwardly directed flap element.

10. The diverter construction as in claim 9 wherein the flap elements are connected to one another.

11. The diverter construction as in claim 9 wherein the spout unit has a generally tapered configuration.

12. The diverter construction as in claim 9 wherein the side walls of the spout unit are provided with indicia representative of the mouth and eyes of a mythical creature.

13. The diverter construction as in claim 12 wherein the raised side walls of the spout unit have inboard ends which are configured to represent the pointed ears of a mythical creature.

14. The diverter construction as in claim 10 wherein the mounting plate element is further provided with a pair of elongated legs.

15. The diverter construction as in claim 14 further comprising:

a decorative panel element adapted to be secured to said pair of elongated legs.

* * * * *